US011781361B2

(12) United States Patent
Terno

(10) Patent No.: US 11,781,361 B2
(45) Date of Patent: Oct. 10, 2023

(54) APPARATUS FOR MOVING SLIDING DOORS AND WARDROBE DOORS

(71) Applicant: TERNO SCORREVOLI S.P.A. UNIPERSONALE, Varedo (IT)

(72) Inventor: Giovanni Terno, Varedo (IT)

(73) Assignee: TERNO SCORREVOLI S.P.A. UNIPERSONALE, Varedo (IT)

( * ) Notice: Subject to any disclaimer, the term of this patent is extended or adjusted under 35 U.S.C. 154(b) by 11 days.

(21) Appl. No.: 17/614,605

(22) PCT Filed: May 15, 2020

(86) PCT No.: PCT/EP2020/025224

§ 371 (c)(1),
(2) Date: Nov. 29, 2021

(87) PCT Pub. No.: WO2020/249254

PCT Pub. Date: Dec. 17, 2020

(65) Prior Publication Data

US 2022/0195775 A1 Jun. 23, 2022

(30) Foreign Application Priority Data

Jun. 11, 2019 (IT) ..... 102019000008625

(51) Int. Cl.
*E05F 3/00* (2006.01)
*E05D 15/00* (2006.01)
(Continued)

(52) U.S. Cl.
CPC ..... *E05F 1/16* (2013.01); *E05D 15/063* (2013.01); *E05F 5/003* (2013.01); *E05F 5/027* (2013.01);
(Continued)

(58) Field of Classification Search
CPC ... E05F 5/003; E05F 5/027; E05F 5/05; E05F 1/08; E05F 1/1091; E05F 1/16;
(Continued)

(56) References Cited

U.S. PATENT DOCUMENTS 8,402,606 B1 * 3/2013 Tsai ..... E05F 3/18 16/49
9,605,461 B2 * 3/2017 Zimmer ..... E05D 15/0669
(Continued)

FOREIGN PATENT DOCUMENTS

EP 2330268 A2 6/2011
JP 2001227233 A * 8/2001
(Continued)

OTHER PUBLICATIONS

International Search Report dated Aug. 6, 2020 for WO 2020249254 A1 (2 pages).
(Continued)

*Primary Examiner* — Chuck Y Mah
(74) *Attorney, Agent, or Firm* — AMSTER ROTHSTEIN & EBENSTEIN LLP

(57) ABSTRACT

An apparatus for moving sliding doors and wardrobe doors fixed to the inner face of the top of a door includes at least one carriage and at least one braking device with a slider pulled by at least one coil return spring. The door is hung from a beam made up of two extruded profiles, the first of which is fastened to the wall with screws and relative plugs; the second extruded profile is fastened to the first profile with snap-in couplings. These coupled profiles define a cavity in which the braking device is housed and stabilised with screws, fixed on a cantilevered bracket of the second extruded profile. The latter defines a sliding track for the wheels or bearings of the carriage(s), fixed to the door at a recess.

16 Claims, 5 Drawing Sheets

(51) Int. Cl.

| | |
|---|---|
| ***E05F 1/16*** | (2006.01) |
| ***E05D 15/06*** | (2006.01) |
| ***E05F 5/00*** | (2017.01) |
| ***E05F 5/02*** | (2006.01) |

(52) U.S. Cl.
CPC ..... *E05Y 2201/614* (2013.01); *E05Y 2201/64* (2013.01); *E05Y 2600/53* (2013.01); *E05Y 2600/628* (2013.01); *E05Y 2800/24* (2013.01); *E05Y 2800/426* (2013.01)

(58) Field of Classification Search
CPC ..... E05F 3/00; E05F 3/02; E05F 3/04; E05F 3/18; E05F 3/227; E05F 3/22; E05F 3/10; E05F 3/108; E05F 3/224; E05Y 2800/24; E05Y 2800/426; E05Y 2201/64; E05Y 2201/614; E05Y 2201/644; E05Y 2201/264; E05Y 2201/41; E05Y 2201/47; E05Y 2201/21; E05Y 2201/488; E05Y 2201/48; E05Y 2201/482; E05Y 2201/492; E05Y 2900/132; E05Y 2900/142; E05Y 2900/14; E05Y 2600/53; E05Y 2600/628; Y10T 16/27; Y10T 16/56; Y10T 16/61; Y10T 16/593; Y10T 16/276; Y10T 16/281; E05D 15/063; E05D 15/0652
See application file for complete search history.

(56) References Cited

U.S. PATENT DOCUMENTS

| | | | | |
|---|---|---|---|---|
| 9,611,684 | B2 * | 4/2017 | Zimmer | E05F 1/16 |
| 2009/0096339 | A1 * | 4/2009 | Worner | E05F 1/16<br>312/334.44 |
| 2015/0247349 | A1 * | 9/2015 | Terno | E05D 15/063<br>49/409 |
| 2016/0138311 | A1 * | 5/2016 | Kreyenborg | E05D 15/063<br>49/506 |
| 2016/0138314 | A1 * | 5/2016 | Kreyenborg | E05D 15/0647<br>49/420 |
| 2016/0369548 | A1 * | 12/2016 | Dodge | E05F 3/224 |
| 2017/0198511 | A1 * | 7/2017 | Shin | E05F 1/16 |
| 2020/0157868 | A1 * | 5/2020 | Terno | E05F 5/003 |
| 2020/0224473 | A1 * | 7/2020 | Terno | E05D 15/063 |
| 2020/0355004 | A1 * | 11/2020 | Martin | E05F 5/003 |

FOREIGN PATENT DOCUMENTS

| | | | | |
|---|---|---|---|---|
| WO | WO-2005095743 | A1 * | 10/2005 | E05D 15/0656 |
| WO | WO-2006011294 | A1 * | 2/2006 | E05F 1/16 |
| WO | 2015032684 | A1 | 3/2015 | |

OTHER PUBLICATIONS

International Preliminary Report on Patentability (IPRP) for PCT/EP2020/025224 (7 pages).

* cited by examiner

APPARATUS FOR MOVING SLIDING DOORS AND WARDROBE DOORS

CROSS REFERENCE TO RELATED APPLICATIONS

This application is a national phase of PCT application No. PCT/EP2020/025224, filed on 15 May 2020, which claims priority from Italian patent application no. 102019000008625, filed on 11 Jun. 2019, all of which are incorporated herein by reference.

BACKGROUND OF THE INVENTION

Field of the Invention

The present invention relates to an apparatus for moving sliding doors and wardrobe doors.

More specifically, the present invention refers to a safe sliding and braking device for sliding doors or wardrobe doors wherein at least one of the carriages fixed to the sliding door comprises a device suitable to perform the dual function of activating the cushioned closing and safety mechanism against accidental release of said door from the track which it is made to move along.

Description of Related Art

It is known that sliding doors are typically combined with braking devices to prevent them from violently hitting the respective end stops, both when opening and closing. The sliding of such doors, widely used to close the passage between two adjoining rooms, is performed by means of one or more carriages fitted with wheels or bearings, which move along a horizontally extending guide; this typically consists of an extruded aluminium profile, forming a longitudinally extending seat which receives the carriages and which comprises means suitable for limiting excursion of the same at opposite ends. Said braking device or cushioned stopping system makes it possible to overcome the inconvenience that the user does not always push the door gradually up to the end stop; so that sometimes the impact of the door when stopping is violent and causes not only noise, but also possible significant damage to the carriages. The latter may, in fact, come out of the respective sliding guide and require laborious repair work as a result. In order to overcome these drawbacks, specific devices have been designed to gradually accompany the door to the end stop when opening and closing; these devices typically comprise a spring, which is loaded by the pull caused by an activator acting on it when the door is opened.

The activator is therefore an essential element for the operation of the cushioned stop.

It is also known that the sliding doors in question are traditionally fitted with safety devices to prevent accidental unhooking or overrunning which may make the door come out of the track it slides along and block it. Some types of anti-release safety systems are known, which must be applied manually according to specific assembly instructions; a fundamental drawback of these safety systems lies in the fact that they allow the sliding door to operate even if they have not been activated/installed correctly.

EP 2 330 268 describes a sliding door guide with a stop consisting of an air damper; the guide comprises a pair of profiles and a carriage moving on a rail of one of the profiles. The German patent DE 1020 13100971 instead discloses a fitting for a sliding door comprising a rail, on which a moving part combined with a stop is arranged, and a motorized automatic rewinder that can be arranged along a guide path and coupled to an activator to move the moving part.

Overall, said sliding doors traditionally require the presence of two separate components for their correct operation, namely a cushioned stop activator and a device that prevents the door or wardrobe door from being accidentally released from its sliding track. The need to prepare and install these two components gives rise to major drawbacks, first of all due to the fact that they have to be made and installed independently in the context of an apparatus for moving sliding doors; moreover, the anti release device, although present, is not always able to guarantee effective functioning, since in some situations it can still allow the door to slide even if installed by the operator in a partially or totally inappropriate manner.

BRIEF SUMMARY OF THE INVENTION

The purpose of the present invention is to overcome the drawbacks complained of above.

More particularly, the purpose of the present invention is to provide an apparatus for moving sliding doors comprising a braking device in which a spring is loaded by pulling an actuator device and wherein the latter also constitutes the device able to prevent the accidental release of the door from the sliding track.

A further purpose of the invention is to provide an apparatus for moving sliding doors wherein said actuator element of the braking device is able to function only if correctly installed, as also the anti-release device.

A no less important purpose of the invention is to provide an apparatus for moving sliding doors as defined above wherein a safety system allows a fail-safe assembly of the various components to guarantee the correct functioning of the sliding door.

A further purpose of the invention is to make available to users an apparatus for moving sliding doors suitable to ensure a high level of resistance and reliability over time, in addition such as to be easily and economically made. These and other purposes are achieved by the apparatus for moving sliding doors of the present invention according to the main claim.

BRIEF DESCRIPTION OF THE DRAWINGS

The construction and functional characteristics of the movement apparatus of the present invention will be more clearly comprehensible from the detailed description below in which reference is made to the appended drawings which show a preferred and non-limiting embodiment and wherein.

DETAILED DESCRIPTION

Figure 1:
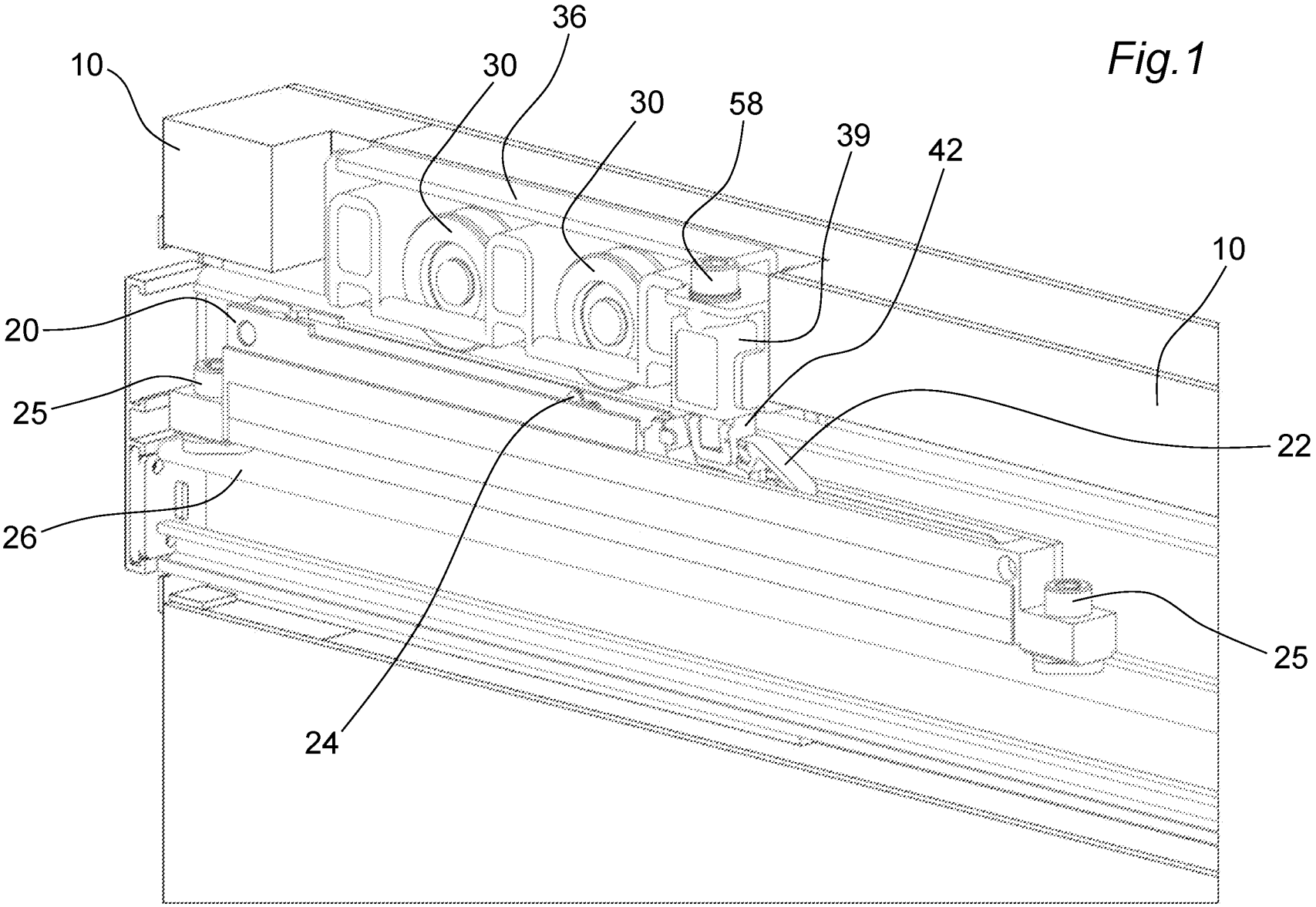
FIG. 1 schematically shows a partial axonometric view of the movement apparatus of the present invention applied to a face of a door in the upper part thereof.
Figure 2:
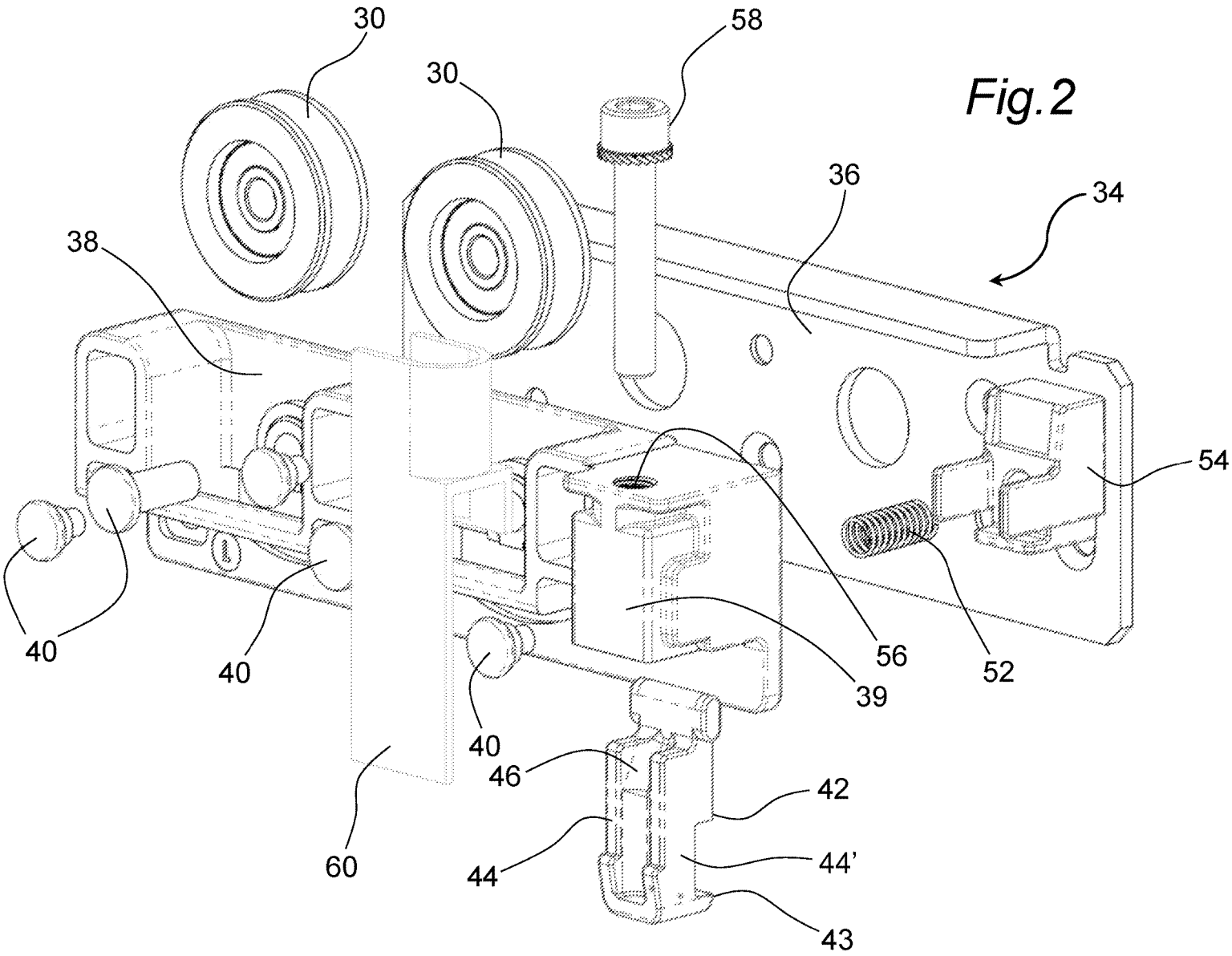
FIG. 2 shows schematically, in exploded view, a part of the same apparatus, to highlight the actuator element of the braking device and the anti-release device connected to the structure of a sliding carriage.
Figure 3:
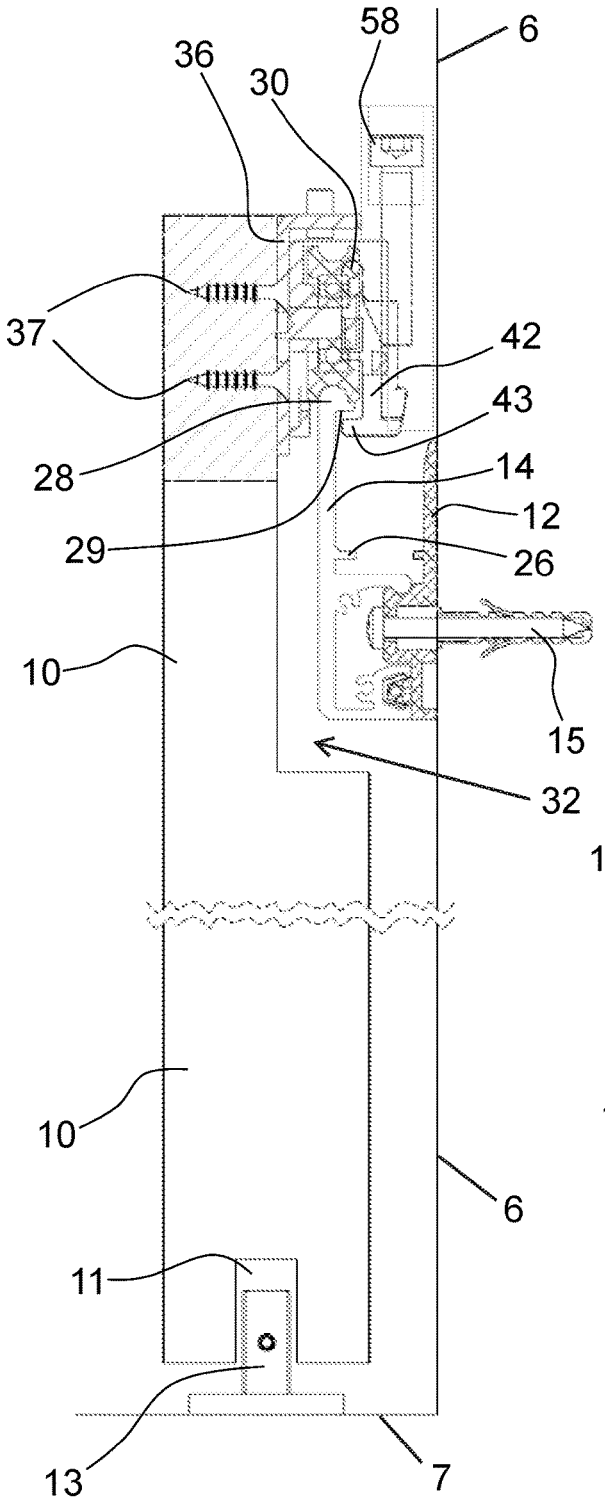
FIG. 3 schematically represents a side view in partial cross-section of the door with the movement apparatus of the present invention at the top and with the anti-release device in the operating position.
Figure 4:
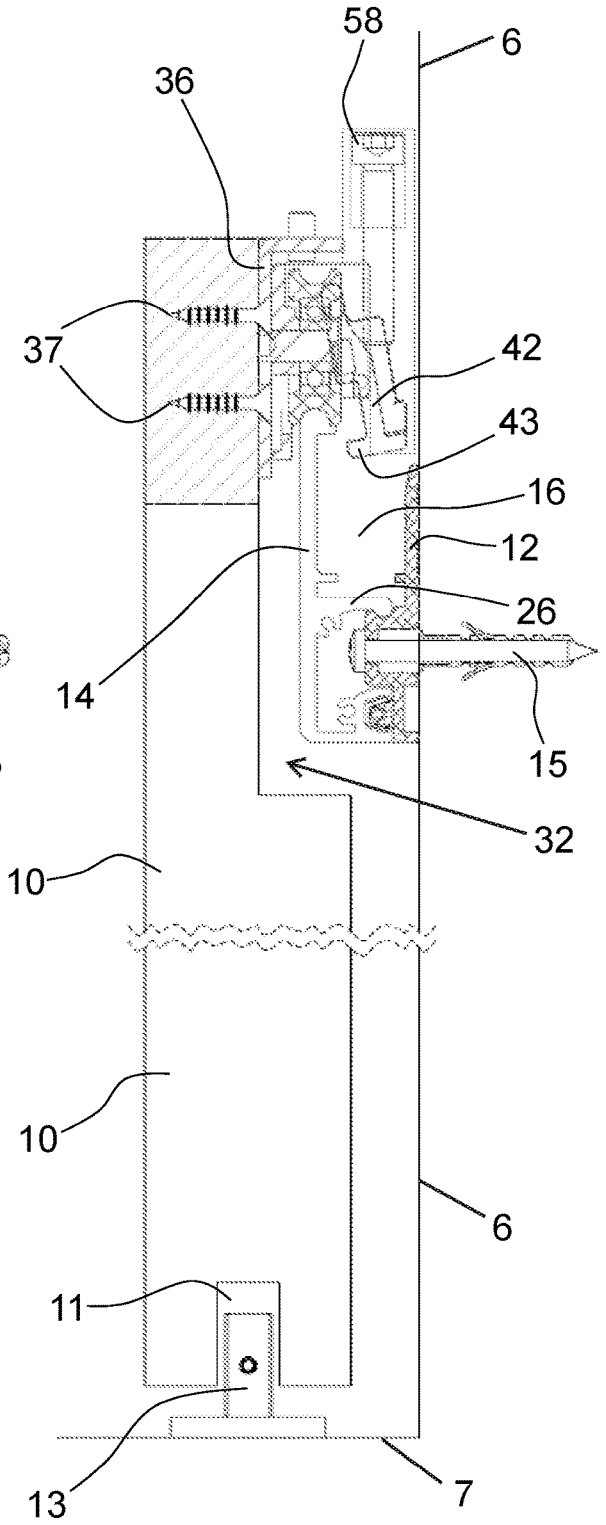
FIG. 4 schematically represents a side view in partial cross-section of the door with the movement apparatus of the present invention at the top and with the anti-release device in a non-operating position.
Figure 5:
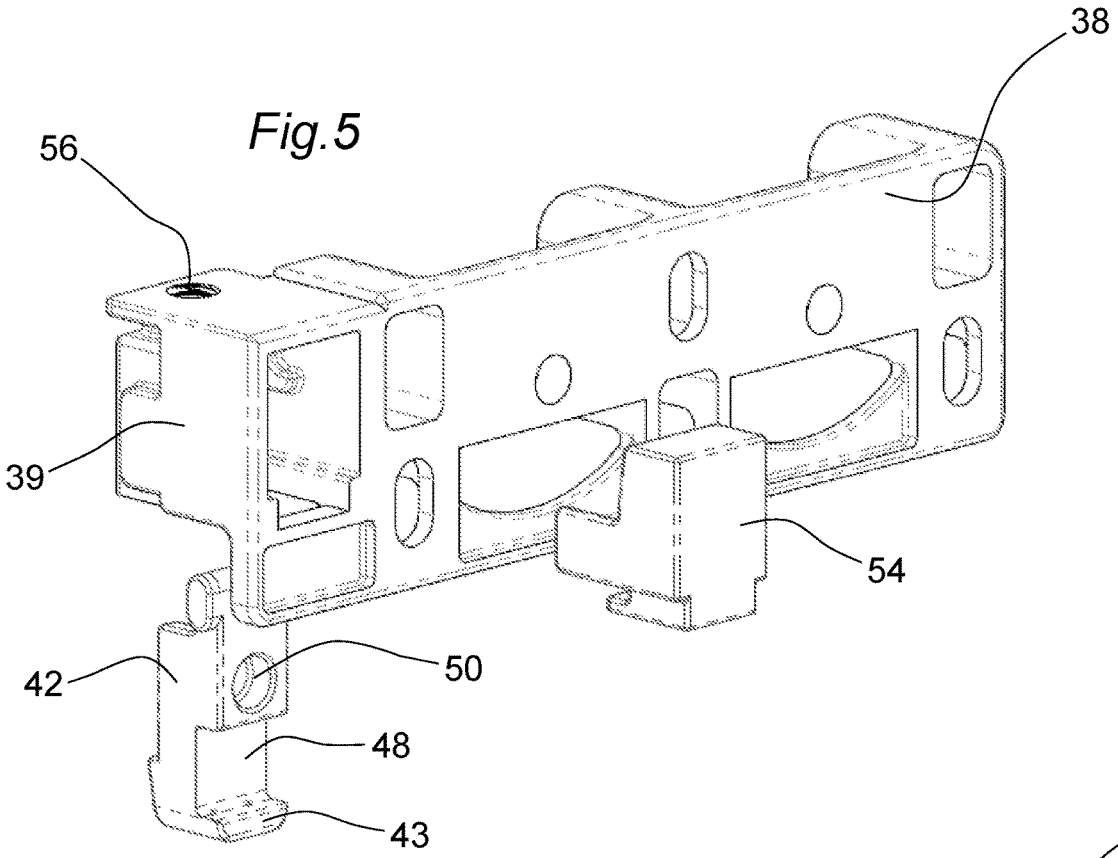
FIG. 5 shows schematically in exploded view, the bearing support of the sliding carriage of the movement apparatus, to highlight the actuator element of the braking device and its housing.
Figure 6:
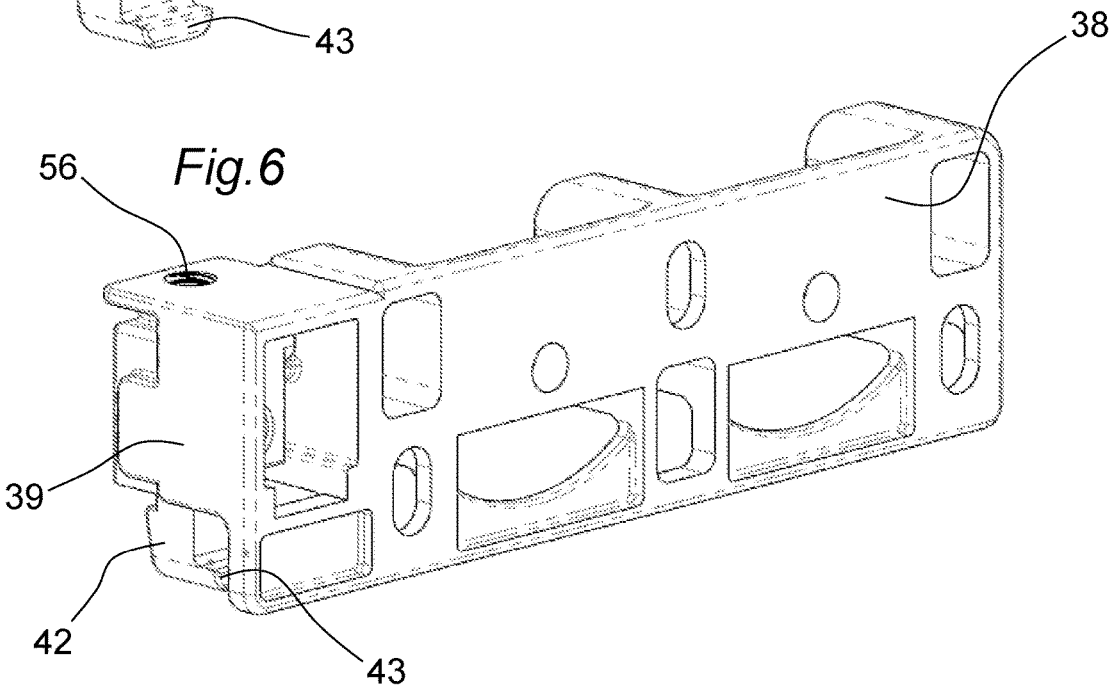
FIG. 6 schematically shows an axonometric view from the rear face of the same sliding carriage of the movement apparatus.
Figure 8:
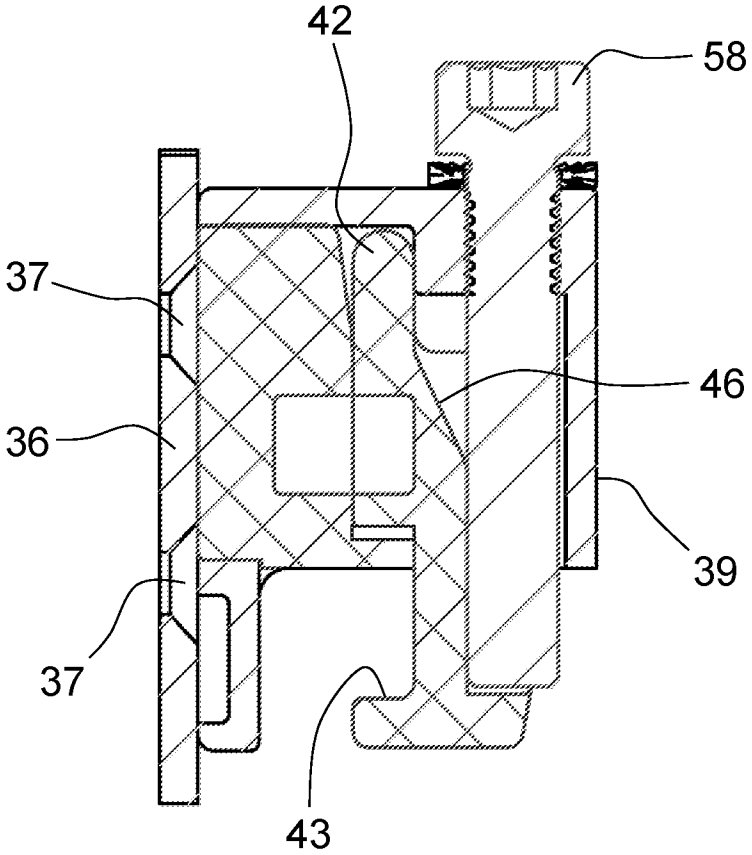
FIG. 8 schematically represents an enlarged detail of the actuator element which also acts as an anti-release device in the condition of correct and definitive installation on the movement apparatus of the present invention.
Figure 7:
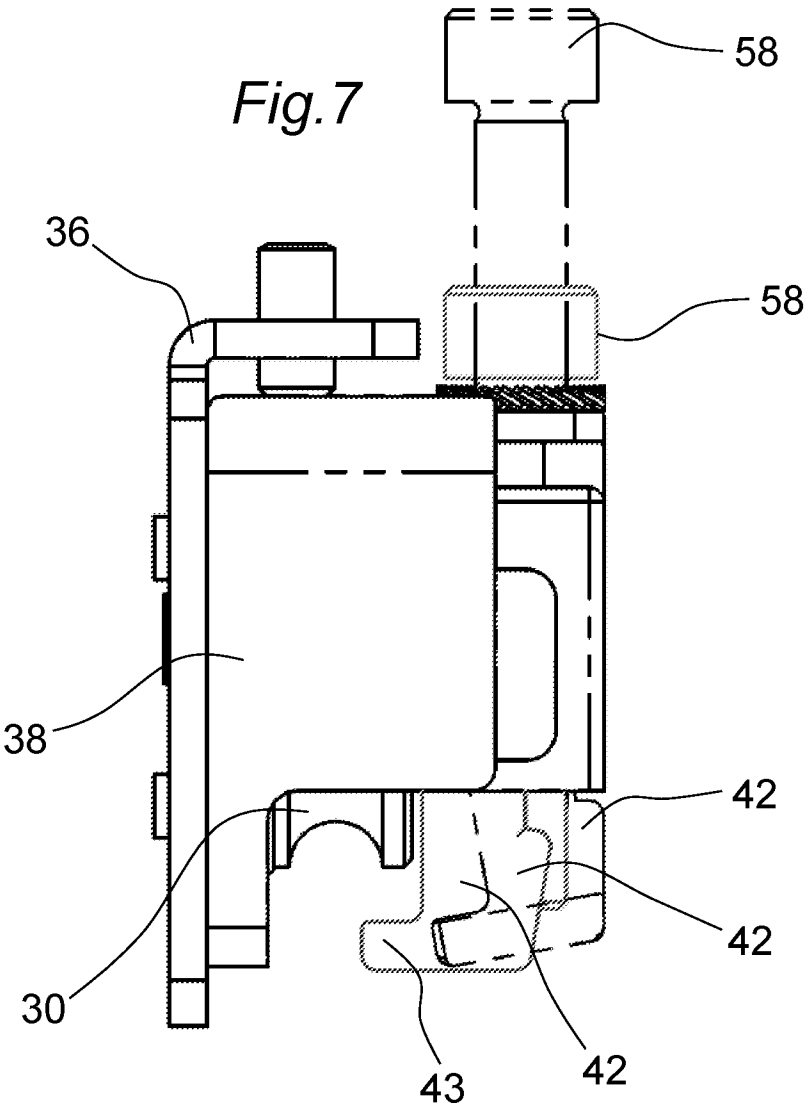
FIG. 7 schematically represents an enlarged detail of the actuator element of the braking device which also acts as an anti-release device in the condition preceding its correct and definitive installation on the movement apparatus.

With initial reference to FIGS. 1 to 4, the movement apparatus for sliding doors of the present invention is fixed to the non-visible inner face and to the upper part of a door 10; the latter can be made of wood, glass and aluminium, plastic or other suitable material and is hung from a beam formed by two extruded profiles 12, 14, as in FIGS. 3 and 4, the first of which is fastened to the wall 6 with screws 15 and relative plugs. At the bottom of the door 10, a longitudinal milling 11 is provided for sliding along a conventional guide 13 which is mounted to the floor 7. The second extruded profile 14 is fixed to the first profile 12 with snap-in couplings; overall the extruded profiles 12 and 14 coupled together define a cavity 16 inside which at least one braking device 20 of the type in itself known is housed and stabilized with screws 18, equipped with a slider 22 able to drag and load a coil return spring 24 when the door is made to slide in opening. The braking device 20 is fixed with screws 25 on a cantilevered bracket 26 of the second extruded profile 14, as shown in FIG. 1, which also shows the slider 22. The beam formed by the pair of extruded profiles 12 and 14 coupled together defines at the top a slot from which the slider 22 protrudes; the second extruded profile 14 defines a sliding track 28 for the wheels or bearings 30 of one or more carriages fixed to the door 10 at a recess 32. One of the carriages, illustrated in exploded view and globally denoted by reference numeral 34 in FIG. 2, comprises a bottom, plate-shaped structure 36 which is fixed to the door 10 by conventional screws 37 and a support 38 for the bearings 30, fastened with rivets 40 to the bottom structure 36. The carriage 34 of the apparatus of the present invention also comprises, on the support 38, a cantilevered seat 39 open in the lower and rear part for housing the anti-release device, which also acts as actuator of the braking device 20; said anti-release device, denoted by reference numeral 42 in FIG. 1, is visible in more detail in FIGS. 2, 5 and 6 and consists of an irregular, prismatic-shaped body with two, paired vertical side walls 44, 44' and a rear wall 48 having an initial portion 46 partly inclined forward, as in FIGS. 2 and 8. The rear wall 48 has a through-hole 50 in which a coil spring 52 is housed. The bottom of the anti-release device 42 connects the vertical side walls 44, 44' with each other and with the rear wall 48 and forms on one side an integral flat appendage 43, oriented in the direction of the second extruded profile 14; the latter comprises under the sliding track 28 an undercut 29 which will be discussed later. The cantilevered seat 39 is also open at the back and houses a cover 54 that partially delimits the anti-release device 42, designed to be inserted from below into said seat 39. The latter is provided on the upper face with a threaded hole 56 in which a screw 58 is inserted, which stabilizes the anti-release device 42 in the seat 39 and orients it correctly in a vertical position. The insertion step of the screw 58 into the hole 56 and the relative progressive screwing are shown in FIG. 7, where the gradual movement (dotted line) made by the anti-release device 42 which progressively orientates itself vertically can be seen; from FIG. 4 also it can be seen that the screwing of said screw 58, starting from the abutment with the inclined portion 46 of the anti-release device 42 leads the same to tilt by effect of the spring 52 and to straighten itself. FIGS. 3 and 8 show the final condition of said device 42, following the complete tightening of the screw 58, which proves arranged vertically; its bottom appendage 43 is, at this point arranged exactly below the undercut 29 and at a minimum distance from it, so that the carriage 34 cannot accidentally lift itself by a sufficient height to cause the bearings 30 to disengage or overrun the guide rail 28.

A plastic safety cover 60 originally shields the cantilevered seat 39 and can only be removed when the screw 58 has been correctly inserted and the anti-release device 42 has been correctly positioned; otherwise, the additional thickness of the safety cover 60 prevents the cushioned return/stop from working. In addition, the presence of the safety cover 60 would be noticeable on the installed door, impacting very negatively on the aesthetics of the door itself.

As stated above, the anti-release device 42 also simultaneously performs the function of actuator of the braking device 20. In fact, as shown in FIG. 1, the anti release device 42 faces, with its lower end comprising the flat appendage 43, in the direction of the braking device 20, from which the conventional slider 22 protrudes; said anti-release device 42, therefore, is advantageously able to abut and drag said slider when the door 10 is opened, with the result of loading the coil spring of the braking device 20. The part of said anti-release device 42 which intervenes on the slider 22 is the part opposite its bottom appendage 43 which cooperates with the undercut 29 of the sliding track 28 to prevent the bearings 30 of the carriage 34 from coming out of the siding track 28.

As may be seen from the above, the advantages which the invention achieves are evident.

In the movement apparatus for sliding doors of the present invention it is possible to combine in a single component two fundamental functions, that is to avoid the danger of accidental release or exit of the carriage 34 from the sliding track 28 and to drag the slider 22 to load the coil return spring of the braking device 20; this component by means of which both the above mentioned results are obtained consists of the anti-release device 42, which is also installed in the apparatus of the invention in such a manner as to exclude malfunctions or errors. In fact, said anti-release device 42 also constitutes the actuator of the slider 22 of the braking device 20, with the consequence that its possible incorrect positioning would be immediately obvious as it would prevent the correct movement of the door 10.

Despite the invention having been described above with particular reference to one of its embodiments, given solely by way of a non-limiting example, modifications and variants will appear evident to a person skilled in the art in the light of the above description. The present invention therefore sets out to embrace all the modifications and variants which fall within the sphere and scope of the following claims.

The invention claimed is:

1. A movement apparatus for moving sliding doors and wardrobe doors fixed to a inner face of a top of a door comprising:

a carriage and a braking device with a slider suitable to pull a coil return spring, said door being hung from a beam formed by a first extruded profile and a second extruded profile, wherein said first and second extruded profiles are coupled together with snap-in couplings and define a cavity in which the braking device with the slider is housed and stabilized with one or more first screws;

wherein the second extruded profile defines a sliding track for the wheels or bearings of the carriage, the carriage being afixed within a recess of the door at a recess and wherein said braking device is fixed on a cantilevered bracket of the second extruded profile, the carriage being provided with a bottom plate-shaped structure fixed to the door with one or more second screws and a support for said wheels or the bearings. fastened with rivets to said bottom plate-shaped structure, the carriage being further provided, on the support, with a cantilevered seat open in a lower part for housing an anti-release device, which forms an actuator of the braking device.

2. The movement apparatus according to claim 1, wherein said anti-release device consists of includes a body of irregular prismatic shape with two paired vertical side walls and a rear wall having an initial portion partly inclined forward, said rear wall being provided with a through-hole in which a coil spring is housed.

3. The movement apparatus according to claim 2, further comprising a safety cover element which originally shields the cantilevered seat and which, if not correctly removed, prevents correct operation of the braking device.

4. The movement apparatus according to claim 2, wherein a bottom of the anti-release device connects the paired vertical side walls with each other and with the rear wall, and forms at the a lower end of a face, an integral flat appendage oriented in a direction of the second extruded profile.

5. The movement apparatus according to claim 4, further comprising a safety cover element which originally shields the cantilevered seat and which, if not correctly removed, prevents correct operation of the braking device.

6. The movement apparatus according to claim 4, wherein the second extruded profile forms an undercut below the sliding track.

7. The movement apparatus according to claim 6, further comprising a safety cover element which shields the cantilevered seat and which, if not correctly removed, prevents correct operation of the braking device.

8. The movement apparatus according to claim 6, wherein the cantilevered seat is open on a rear face and houses a cover that partially delimits the anti-release device designed to be inserted from below and stabilised in said cantilevered seat.

9. The movement apparatus according to claim 8, wherein the anti-release device faces, with its bottom end comprising a flat appendage, in a direction of the braking device, from which the slider abuts and is moved by said anti-release device protrudes.

10. The movement apparatus according to claim 9, characterised in that wherein said flat appendage of the anti-release device abuts under the undercut.

11. The movement apparatus according to claim 10, further comprising a safety cover element which shields the cantilevered seat and which, if not correctly removed, prevents correct operation of the braking device.

12. The movement apparatus according to claim 9, further comprising a safety cover element which shields the cantilevered seat and which, if not correctly removed, prevents the correct operation of the braking device.

13. The movement apparatus according to claim 8, further comprising a safety cover element which shields the cantilevered seat and which, if not correctly removed, prevents correct operation of the braking device.

14. The movement apparatus according to claim 8, wherein the cantilevered seat is provided on an upper face with a threaded hole into which a third screw is inserted, which stabilises the anti-release device in said cantilevered seat orienting it in a vertical position.

15. The movement apparatus according to claim 14, further comprising a safety cover element which shields the cantilevered seat and which, if not correctly removed, prevents correct operation of the braking device.

16. The movement apparatus according to claim 1, further comprising a safety cover element which shields the cantilevered seat and which, if not correctly removed, prevents correct operation of the braking device. .

* * * * *